United States Patent [19]

Rudy

[11] Patent Number: 4,936,806

[45] Date of Patent: Jun. 26, 1990

[54] FLOATATION DEVICE FOR SWIMMERS

[76] Inventor: Issac Rudy, 711 Ave. R, Brooklyn, N.Y. 11223

[21] Appl. No.: 353,465

[22] Filed: May 18, 1989

[51] Int. Cl.[5] ..... A63B 31/08

[52] U.S. Cl. ..... 441/122; 441/59

[58] Field of Search ..... 441/59, 122, 111, 112, 441/88, 116, 118, 131, 102, 103, 107; 272/71, 116

[56] References Cited

U.S. PATENT DOCUMENTS

| | | | |
|---|---|---|---|
| 974,158 | 11/1910 | Klint | 441/107 |
| 1,535,481 | 4/1925 | Kjelgaard | 441/59 X |
| 2,305,606 | 12/1974 | Craig et al. | 441/107 |
| 3,820,179 | 6/1974 | Maertin | 441/122 |
| 4,692,125 | 9/1987 | Wessman | 441/112 |

FOREIGN PATENT DOCUMENTS

| | | | |
|---|---|---|---|
| 3539528 | 3/1987 | Fed. Rep. of Germany | 441/59 |
| 620973 | 5/1961 | Italy | 441/59 |

*Primary Examiner*—Sherman D. Basinger
*Assistant Examiner*—Edwin L. Swinehart
*Attorney, Agent, or Firm*—Abelman Frayne Rezac & Schwab

[57] ABSTRACT

A floatation device for use by swimmers and which is to be positioned over a user's upper arm in encircling relation therewith, includes an extension adapted to extend over the shoulder of the swimmer to stabilize the device against slippage longitudinally of the user's upper arm, and another extension that can be grasped by a supervisor of the swimmer in the event of an emergency, the respective extensions being formed contiguously with the floatation device.

2 Claims, 1 Drawing Sheet

FLOATATION DEVICE FOR SWIMMERS

FIELD OF THE INVENTION

This invention relates to a device to be worn in encircling relation with a user's upper arm, and which provides a floatation device for the user when emersed in water.

BACKGROUND OF THE INVENTION

Devices of this type are well known in the art, including a device as disclosed in U.S. Design Patent Des. 205,327, issued July 19, 1986 to Lukas, which is in the form of dual inflatable annular air chambers adapted to be positioned over and encircle a user's upper arm, the air chambers being connected to each other in parallel relation and each having an inflation nipple. The advantage of such a construction is that reduced but still adequate buoyancy is provided to the user in the event of puncturing of one of the air chambers, or, the accidental dislodgement of the closure plug of the inflation nipple associated with that chamber.

Such devices closely embrace the user's upper arm with a frictional grip to minimize the tendency of the device to slip longitudinally off the user's arm when in a straightened position. However, if the user's arm is wet, the film of water on the user's arm provides an efficient lubricant for the material from which the device has been formed, typically polyvinylchloride sheeting. This allows for the slippage of the device longitudinally of the user's arm.

Also, such a device is somewhat difficult to grip in the event that a supervisor is required to give quick assistance to the user, who possibly is an inexperienced swimmer such as a learning child.

SUMMARY OF THE INVENTION

Optionally, but not essentially the floatation device is comprised of dual inflatable annular air chambers which are connected in parallel with each other, and which each include an inflation nipple permitting inflation of that chamber. While this construction is preferable, it is not essential in that a single inflatable annular air chamber can be employed, or, the device can be formed from a buoyant material by molding.

Extending laterally from one of the annular chambers in one direction longitudinally of the user's arm, and formed integrally with the associated annular air chamber is a first extension adapted to extend upwardly over the user's shoulder, the first extension being inflated in unison with the associated annular air chamber. This provides stability on the user's arm against slippage of the device along the user's arm and towards the user's hand, such as commonly occurs in the event that the user is playing in water. There is a possibility that the device will rotate about the user's upper arm due to the force of water impacting against the device. Should this happen, the device is still positionally held longitudinally on the user's upper arm, in that the extension will still remain engaged over the user's shoulder.

Extending from the other inflatable annular air chamber and in an opposite direction is a second lateral extension, which is also inflatable in unison with the associated annular air chamber, and, which provides a projection that can easily be grasped by a supervisor in the event that the user is encountering difficulties, thus providing the user with what might be termed handles on each of the user's upper arms.

The device can be of any desired shape and configuration, provided that it meets these requirements, thus making it possible to provide a device simulating, for example, an animal or fish having a head and a tail, or a humanoid or fictitious character having a head and legs, or, a representation of a mechanical device such as an automobile, aeroplane, ship etc. These examples are given as illustrations only of the various shapes and forms the device can simulate and in no way are to be considered limiting as to the many varied forms that can be applied to the floatation device.

Optionally, the floatation device instead of being comprised of at least one inflatable air chamber, can be formed as a molding of any pliant material having inherent floatation properties, such as closed cell foamed plastics materials, or fabric coverings enclosing bubbles of plastics material. In this event, the device would not be collapsible prior to and subsequent to use, but instead would retain is molded form. The formation of the device from such closed cell foamed plastics material, would, of course, enable the molding of the device to extremely complex and highly decorative shapes while retaining the ability of the device to resist slippage of the user's arm, and also that of providing a handle or tail that is easily grasped by a supervisor.

DESCRIPTION OF THE DRAWINGS

The invention will now be described with reference to the accompanying drawings, which illustrate a preferred embodiment of the invention, and, in which.

DESCRIPTION OF THE PREFERRED EMBODIMENT

Figure 1:
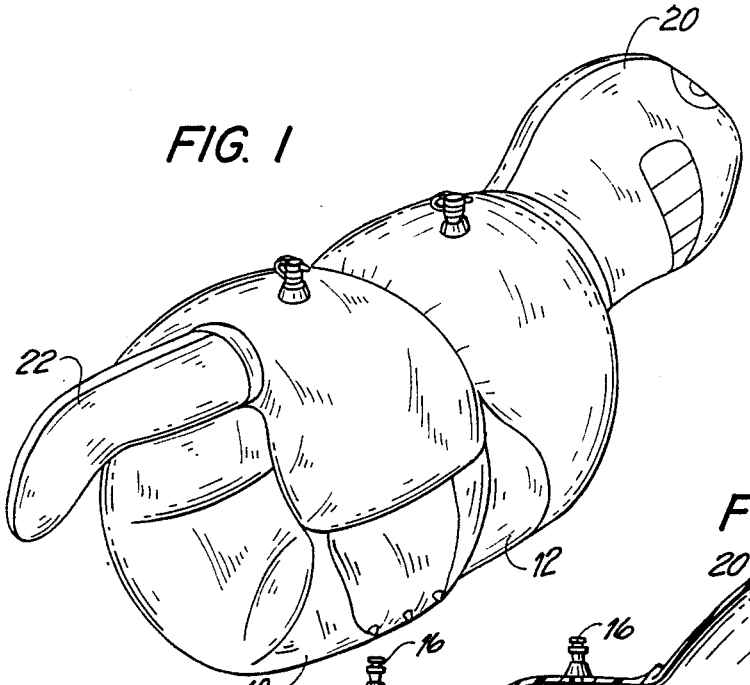
FIG. 1 is a perspective view of the floatation device of the present invention, when in an inflated condition.
Figure 2:
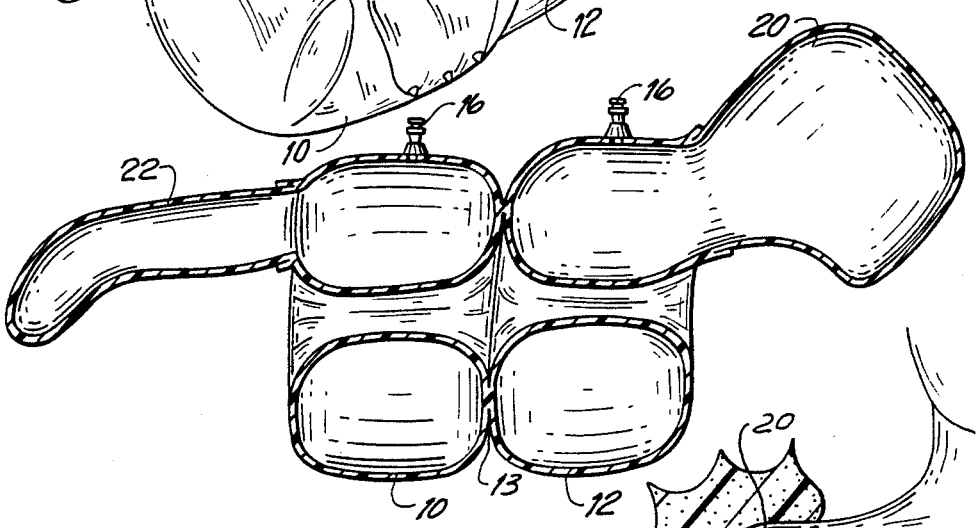
FIG. 2 is a longitudinal section through the device of FIG. 1.

Referring now to the FIGS. 1 and 2, the floatation device includes two separate air chambers 10 and 12 of annular form, and which have been formed from any suitable air-impervious material. Polyvinylchloride sheeting is typical of such suitable materials, in that it is pliant, hydrophobic, and of pleasant touch to the human skin. The air chambers 10 and 12 are joined to each other by a weld 13 in parallel relationship, and, are sized for them to be readily applied about a user's arm with the user's arm extending through the center of the respective annuli. Separate inflation nipples 14, 16 are provided for the respective air chambers 10 and 12, whereby the extent of inflation of either one of the chambers can be changed to the comfort of the user. Also, in the event that one of the inflation nipples should become opened during use of the device, or one of the inflated air chambers 10 or 12 be accidentally perforated, then, the device will remain at least partially operative to support the user in a body of water.

Water will provide an efficient lubricant permitting slippage of the device so far described down the user's arm, in which event, rather than to act as a floatation device for the user, the device can have the opposite result of upsetting the user in a body of water.

According to the present invention, this possibility is minimized by providing an extension 20 in communication with the annular air chamber 12, the extension 20 being of a shape such that, without regard to the position of the device circumferentially of a user's arm, the extension 20 will hook-over the user's shoulder, and be effective to minimize the possibility of the device slipping down the user's arm. The extension 20 is in direct communication with the air chamber 12, and thus, is inflated in unison with the air chamber 12.

The air chamber 10, similarly is provided with an inflatable extension 22 in direct communication with the air chamber 10, and which is inflated in unison with the air chamber 10. The extension 22 is adapted to extend downwardly of the user's arm, and, to extend freely from the air chamber 10. Thus, in the event that the user should be experiencing difficulties in swimming and needs to be retrieved from the body of water, then, a supervisor can grasp the extension 22 in the manner of a handle, and use the handle to forcibly drag the user to safety.

While the floatation device of the present invention is designed primarily for the use of inexperienced swimmers such as learning children, it can, of course, be made of any size appropriate to any persons, including adults.

As illustrated in the drawings, the respective air chambers 10 and 12 and the extensions 20 and 22 can be formed and decorated to simulate an animal, or any other device compatible with the formation of the extension 20 to hook-over the user's shoulder, and, the formation of the extension 22 to remain free of the user's arm and provide a handle that can be grabbed by a supervisor.

The device in its entirety conveniently can be formed from polyvinylchloride sheeting, such a material being readily heat or electrosonically or dielectrically fusible as is well known in the art. Equally well, it could be formed from natural or synthetic rubber material.

While the device illustrated includes dual inflatable air chambers 10 and 12, it will be appreciated that both of the extensions 20 and 22 could be provided on a single inflatable air chamber. Also, it will be appreciated that more than two inflatable air chambers may, if desires, be provided. Two chambers are, however, preferable, in that they will engage the user's upper arm on opposite sides of the bicep, and, the bicep itself will act as a stabilizer maintaining the device in position on the user's upper arm. However, when the user's arm is in a straightened condition, the bicep will be in a stretched condition and exhibit little effect on accidental slippage of the device downwardly on the user's arm. It is at this point that the extension 20 exhibits its intended function of restraining such downward slippage of the device on the user's arm.

Preferably, the extension 22 is arranged to extend at a position spaced from the user's arm, thus providing ready access for grabbing by a supervisor should the need arise.

The exterior configuration and decoration of the device can take any form desired. For example, for it to simulate an animal form, a humanoid form or an imagined form, or, a mechanical device such as a plane, ship or automobile, or it can simulate a fish such as a shark or stingray, or, it can take the form of a robot, or, in fact any other form that will provide an extension 20 adapted to overlie the user's shoulder, and an extension 22 providing a tail or handle that readily can be grabbed by a supervisor.

Figure 3:
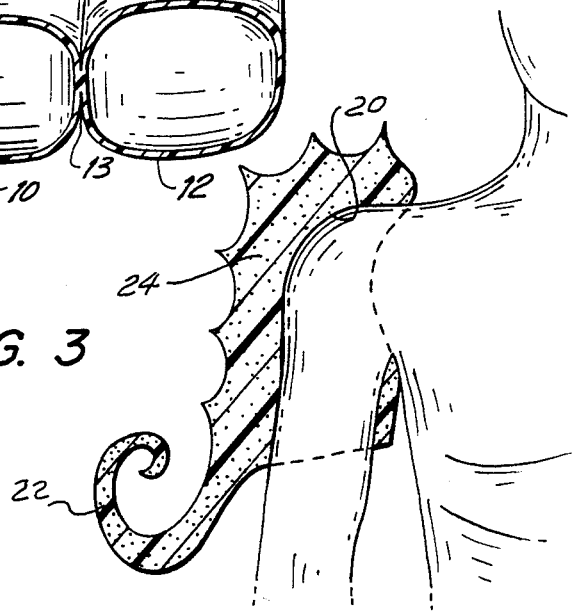
FIG. 3 is a longitudinal cross-section through another form of the device.

While preferable, in that the formation of the device as an inflatable device will faciliate collapsing and storage of the device when not needed in a flattened condition, the floatation device can be formed in any other desired manner having a specific gravity considerably less than water for it to provide the required floatation characteristics. For example, and as shown in FIG. 3, the device can be molded as a three-dimensional device 24 using a suitable closed cell foamed plastics material. Molding of the device will provide widely extended possibilities in the modelling of the device, with, of course, the disadvantage that the device cannot be collapsed when not in use. The device can, however, comprise a child's toy for use as a plaything when not required in its specific use as a floatation device, for example, a toy for use by a child in the bath. As in previous embodiments, the device 24 includes an extension 20 adapted to engage over the user's shoulder, and an extension 22 adapted to be grasped by a supervisor. Innumerable possibilities arise in the specific form of the device, which can be any of these previously mentioned, including, as shown, a simulation of a sea horse.

I claim:

1. A floatation device for use by swimmers, including:

a main body having attachment means and adapted to be attached to a user's upper arm;

a first extension of said device adapted to extend over the shoulder of a user of the device; and, a second extension of said device extending in a direction opposite to said first extension, and which is adapted to extend downwardly of a user's arm in spaced relation therewith, and which can be grabbed by a supervising person and used to haul a swimmer to a position of safety;

said floatation body being comprised of two inflatable members formed from sheet plastics material, said first extension being in direct communication with one of said inflatable members and being inflatable in unison therewith, said second extension being in direct communication with said other inflatable member and being inflated in unison therewith.

2. The floatation device of claim 1, in which each of said floatation body, said first extension and said second extension provides a specific gravity considerably less than one.

* * * * *